US005205727A

United States Patent [19]

Aoki et al.

[11] Patent Number: 5,205,727

[45] Date of Patent: Apr. 27, 1993

[54] PULSE COMBUSTOR

[75] Inventors: Yutaka Aoki, Sapporo; Tadashi Itakura, Ebetu, both of Japan

[73] Assignee: Paloma Kogyo Kabushiki Kaisha, Nagoya, Japan

[21] Appl. No.: 927,161

[22] Filed: Aug. 7, 1992

[30] Foreign Application Priority Data

Aug. 13, 1991 [JP] Japan ..... 3-228827

[51] Int. Cl.[5] ..... F23C 11/04

[52] U.S. Cl. ..... 431/1

[58] Field of Search ..... 431/1

[56] References Cited

U.S. PATENT DOCUMENTS

| | | | |
|---|---|---|---|
| 2,898,978 | 8/1959 | Kitchen et al. | 431/1 |
| 4,080,149 | 3/1978 | Wolfe | 431/1 |
| 4,457,691 | 7/1984 | Hisaoka et al. | 431/1 |
| 4,715,807 | 12/1987 | Yokoyama et al. | 431/1 |
| 4,891,003 | 1/1990 | Ishiguro | 431/1 |

*Primary Examiner*—Carroll B. Dority
*Attorney, Agent, or Firm*—Lahive & Cockfield

[57] ABSTRACT

The present invention provides a simply constructed, improved pulse combustor realizing stable pulse combustion with less noise and vibration. The pulse combustor includes: a combustion chamber; a mixing chamber coupled with the intake side of the combustion chamber via a first opening provided with a flame trap; and an air chamber connecting to the mixing chamber via second opening. The second opening is eccentric with respect to the first opening. The fuel gas and air are simultaneously supplied through the second opening to the mixing chamber, sufficiently mixed in the mixing chamber, and fed into the combustion chamber. The exhausted gas flown back through the flame trap is diluted with the air/fuel mixture in the mixing chamber and again fed into the combustion chamber for continuous combustion while the reverse pressure is efficiently reduced by the mixing chamber and the air chamber.

10 Claims, 6 Drawing Sheets

PULSE COMBUSTOR

BACKGROUND OF THE INVENTION

1. Field of the Invention

The present invention relates to a pulse combustor for continuously combusting mixture of air and fuel gas supplied to a combustion chamber thereof.

2. Description of the Related Art

An example of a conventional pulse combustor for pulsative ignition and continuous combustion of air/fuel mixture is disclosed in Japanese Patent Laying-Open Gazette No. Sho-64-23005. The prior art pulse combustor, as shown in FIG. 6, includes: a nozzle plate NP with plural gas nozzles GN and air nozzles AN; and a resistant plate RP disposed opposite to the nozzle plate NP via a narrow space S. Both the nozzle plate NP and the resistant plate RP are fixed in a combustion chamber R. Rich fuel gas is supplied through a gas conduit GP, the plural gas nozzles GN into the combustion chamber R while air is supplied through the plural air nozzles AN into the combustion chamber R by a fan F. The rich fuel gas and the air are mixed in between the resistant plate RP and the nozzle plate NP and ignited and combusted with spark of an ignition plug SP in the combustion chamber R. Large portion of hot combustion byproducts are exhausted through a tail pipe TP. Although the high explosion pressure in the combustion chamber R tends to cause a back flow of the combustion byproducts to the supply source, the resistant plate RP in the combustion chamber R prevents this undesirable back flow. Exhaustion of the combustion byproducts makes the pressure in the combustion chamber R negative, so that the rich fuel gas and air are again fed into the combustion chamber R and spontaneously ignited and combusted by the residual hot exhausted gas in the combustion chamber R. Ignition and combustion are periodically repeated in the above manner to heat an object like oil in an oil tank.

In the system of the prior art pulse combustor, however, combustion byproducts flown back to the supply source can not efficiently be mixed with the rich fuel gas and air in the combustion chamber R. Relatively high supply pressures of the rich fuel gas and air as well as the resistant plate RP are required to efficiently prevent the back flow of combustion byproducts. More concretely, the pulse combustor requires a high-pressure fan F or a compressor for supplying the high-pressure air and a complicated gas supply unit for supplying the high-pressure fuel gas. These structures unfavorably increase the noise and vibration.

Furthermore, in the prior art system, the fuel gas and air are mixed in the narrow space S between the resistant plate RP and the nozzle plate NP, and this causes non-uniform mixing and thereby unstable combustion.

SUMMARY OF THE INVENTION

The object of the invention is to provide a simply constructed, improved pulse combustor which realizes stable, continuous combustion with less noise and vibration.

The present invention is directed to a pulse combustor for continuous ignition and combustion of air/fuel mixture.

The pulse combustor includes:

a combustion chamber receiving mixture of air and fuel gas for pulsative combustion;

one or plural tail pipes connecting to the combustion chamber for exhausting combustion byproducts from the combustion chamber;

a mixing chamber being coupled with and connected to the combustion chamber via a first opening provided with a flame trap, for mixing air and fuel gas and supplying the air/fuel mixture to the combustion chamber;

an air chamber being coupled with and connected to the mixing chamber via a second opening formed on a face opposite to the first opening, for supplying air to the mixing chamber;

a fan for feeding air into the air chamber; and a gas supply conduit for supplying fuel gas to the mixing chamber, the gas supply conduit going through the air chamber and having one end projecting to connect with the mixing chamber via the second opening.

In the above pulse combustor, the second opening is formed eccentrically with respect to the first opening.

In the pulse combustor of the invention thus constructed, the fuel gas and air are supplied to the mixing chamber via the second opening formed in the air chamber and sufficiently mixed therein. The air/fuel mixture is then fed into the combustion chamber via the flame trap fitted into the first opening. Since the second opening is eccentric with respect to the first opening, the fuel gas and air supplied from the second opening do not. directly flow in the frame trap, but collide with the side wall of the mixing chamber to be sufficiently mixed in the chamber.

The air/fuel mixture supplied to the combustion chamber is then ignited and combusted, for example, with spark of an ignition plug. Hot, high-pressure combustion byproducts are largely exhausted through the tail pipes while being partly flown back to the mixing chamber via the flame trap. The back-flown exhausted gas (combustion byproducts) is cooled through the flame trap, and this temperature drop further causes contraction in volume and lowers the pressure of the exhausted gas. Direct back flow of combustion byproducts into the second opening is efficiently prevented since the second opening is formed eccentrically with the first opening. In the meantime, the reverse pressure is sufficiently reduced by the air chamber and the mixing chamber. The fan used here for supplying air to the mixing chamber thus does not need high pressure or large capacity. Furthermore, the flow of combustion byproducts through the flame trap lowers the explosion pressure in the combustion chamber. These features of the invention allow noise and vibration reduction.

The back-flown combustion byproducts are diluted with the air/fuel mixture spirally flowing in the mixing chamber, and fed into the combustion chamber again for continuous ignition and combustion. The flame trap rectifies the air/fuel mixture to control the ignition point in the combustion chamber, thus allowing stable pulse combustion.

In the above pulse combustor, the mixing chamber may further include a first chamber portion of a relatively large diameter and a second chamber portion of a relatively small diameter, which are concentrically disposed and connected to each other via a ring wall. The air and fuel gas supplied to the mixing chamber collide with the ring wall and spirally flow in the mixing chamber to be sufficiently mixed.

Alternatively, the mixing chamber may include a ring collision plate disposed between the first opening and the second opening. In this structure, the fuel gas and air also collide against the ring collision plate and spirally flow in the mixing chamber to be sufficiently mixed.

In the mixing chamber thus constructed, the fuel gas and air collide against the ring wall or plate and are more sufficiently mixed with each other.

The projecting end of the gas supply conduit may include: an injection opening for injecting fuel gas to the mixing chamber; and an aperture having a smaller diameter than the injection opening. Here the aperture is formed opposite to the injection opening.

Even when combustion byproducts are flown in the gas supply conduit, they are discharged to the air chamber via the aperture. Since the aperture has the smaller diameter than the injection opening, the aperture efficiently prevents the fuel gas from flowing through the aperture into the air chamber. A small amount of the air in the air chamber flows through the aperture into the conduit end, but the ingested air does not prevent smooth supply of the fuel gas but has so-called venturi effect. Namely, the fuel gas is smoothly fed into the mixing chamber by the supply pressure of the fuel gas and the venturi effect of the ingested air.

The pulse combustion is generally affected by the supply pressure of fuel gas under the reverse pressure conditions. The aperture, however, efficiently eliminates the adverse effects of the variation in supply pressure and allows stable pulse combustion at any supply pressure.

The projecting end of the gas supply conduit may further include a check valve for preventing back flow of combustion byproducts into the gas supply conduit.

The check valve is closed to prevent the back flow during ignition and combustion in the combustion chamber, and is opened to supply fuel gas when the reverse pressure becomes lower than the supply pressure of the fuel gas. The check valve allows stable pulse combustion at any supply pressure.

In another aspect of the invention, the air chamber is coupled with and connected to the mixing chamber via a second opening and a third opening, which are formed opposite to the first opening. In this case, the gas supply conduit has a first end connecting with the mixing chamber via the second opening, and a second end connecting with the mixing chamber via the third opening.

These and other objects, features, aspects, and advantages of the present invention will become more apparent from the following detailed description of the preferred embodiment with the accompanying drawings.

DESCRIPTION OF THE PREFERRED EMBODIMENT

Figure 1:
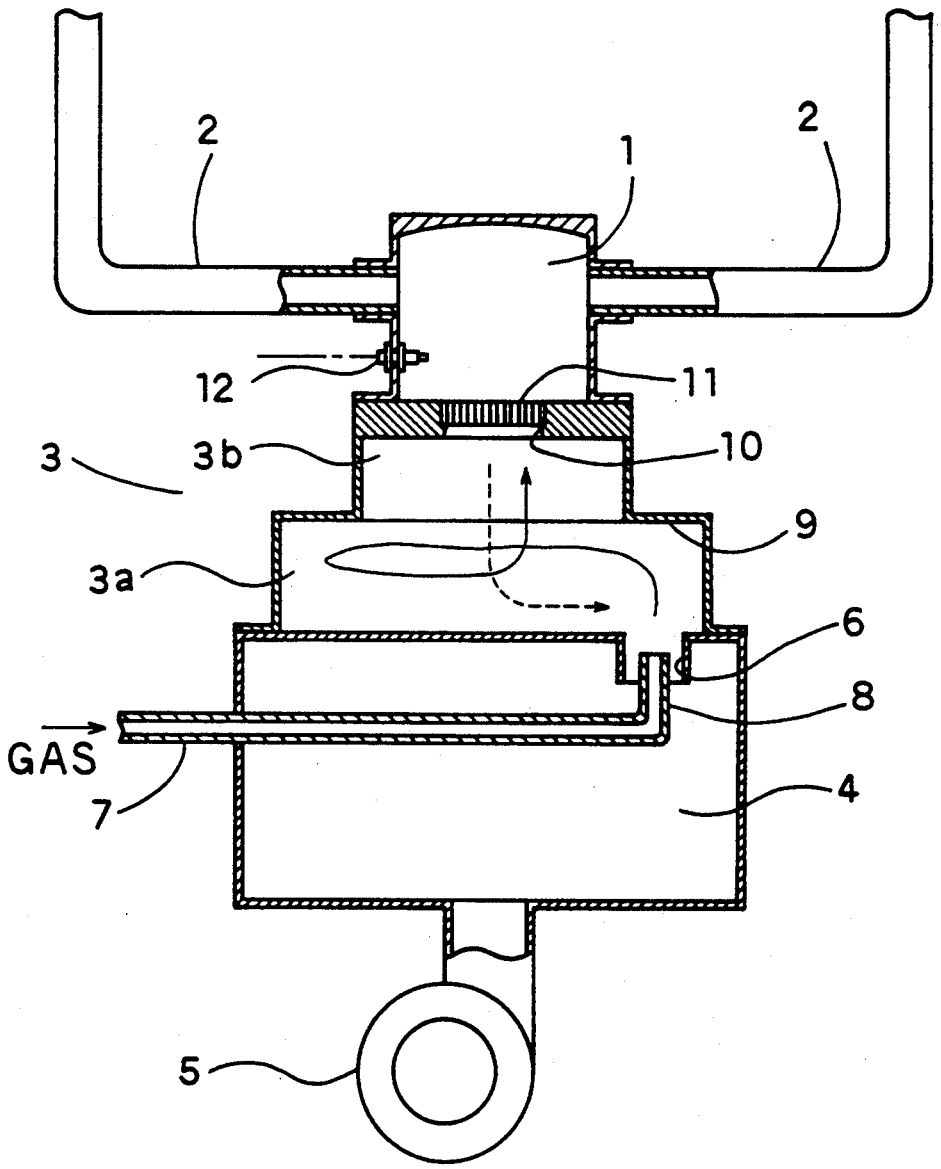
FIG. 1 is a cross sectional view schematically illustrating a pulse combustor as an embodiment of the invention.

FIG. 1 is a cross sectional view schematically illustrating a pulse combustor as an embodiment of the invention. The pulse combustor includes: a combustion chamber 1; two tail pipes 2 formed as conduits of hot exhausted gas; a mixing chamber 3 coupled with the intake side of the combustion chamber 1; an air chamber 4 coupled with the intake side of the mixing chamber 3; and a fan (multiblade fan in the embodiment) 5 for supplying air to the air chamber 4.

The cylindrical air chamber 4 has a second opening 6 on the upper right portion thereof, which connects to the mixing chamber 3. A gas supply conduit 7 for supplying fuel gas goes through the air chamber 4 and has one end 8 projecting to connect with the second opening 6.

The mixing chamber 3 adjacent to the air chamber 4 includes a cylindrical first chamber portion **3*a* of a relatively larger diameter and a cylindrical second chamber portion 3*b* of a relatively smaller diameter, which are concentrically arranged and connected to each other via a ring wall 9**.

The second chamber portion **3*b* of the mixing chamber 3 has a first opening 10 on the center thereof, which connects to the combustion chamber 1. The first opening 10 and the second opening 6 are thus not aligned vertically. A flame trap 11 (in the embodiment, the frame trap used has 600 cells (pores)/square inch; diameter of 43 millimeter; and height of 13 millimeter) is fitted into the first opening 10**.

The two tail pipes 2 are attached to the opposite walls of the cylindrical combustion chamber 1 to form a path through the combustion chamber 1. An ignition plug 12 is also fixed to the combustion chamber 1 for igniting mixture of air and fuel gas to start combustion.

The pulse combustion of the embodiment thus constructed is operated in the following manner.

Fuel gas having a fixed pressure regulated with a gas governor is supplied through the gas supply conduit 7 and the second opening 6 to the mixing chamber 3, while air fed into the air chamber 4 with the fan 5 is also supplied through the second opening 6 to the mixing chamber 3.

The fuel gas and the air simultaneously supplied to the mixing chamber 3 collide with the ring wall 9 of the mixing chamber 3 and spirally flow in the first chamber portion **3*a* to be sufficiently mixed as shown by the arrow of solid line in FIG. 1. The air/fuel mixture is fed into the combustion chamber 1 through the flame trap 11 fitted into the first opening 10 and ignited and combusted by spark of the ignition plug 12 in the combustion chamber 1. Hot, high-pressure combustion byproducts are largely exhausted through the tail pipes 2 by the explosion pressure, while being partly flown back to the mixing chamber 3 through the flame trap 11**.

Since an explosive combustion makes the pressure in the combustion chamber 1 negative, the air/fuel mixture is again fed from the mixing chamber 3 to the combustion chamber 1. The air/fuel mixture is spontaneously ignited and combusted by the residual hot combustion byproducts in the combustion chamber 1. In the above manner, the air/fuel mixture is continuously supplied, combusted, and exhausted in the pulse combustor of the embodiment.

The hot, high-pressure exhausted gas (combustion byproducts) flown back to the mixing chamber 3 is cooled through the frame trap 11. The temperature drop further causes contraction in volume and lowers the pressure of the exhausted gas. In the embodiment, the temperature of the exhausted gas was approximately 1,400° C. in the combustion chamber 1 and then lowered through the flame trap 11 to approximately 200° C. in the mixing chamber 3. According to the Charles' law (V/T=constant; V denotes volume, and T denotes temperature), both the volume and pressure of the exhausted gas are reduced to approximately one third in the mixing chamber 3. The mixing chamber 3 and the air chamber 4 function to reduce the reverse pressure due to the back flow of the exhausted gas. Eccentricity of the first opening 10 and the second opening 6 also eliminates the adverse effects of the reverse pressure on a supply source. The back flow of the combustion byproducts through the first opening 10 sufficiently lowers the explosion pressure in the combustion chamber 1.

The pulse combustor of the embodiment does not require any high-pressure fan nor the high supply pressure of fuel gas. This structure and sufficient reduction of the explosion pressure in the combustion chamber 1 efficiently reduce the undesirable noise and vibration. In the combustor of the embodiment, the turn-down ratio can be raised by regulating the air capacity of the fan 5 and the amount of fuel gas.

Figure 2:
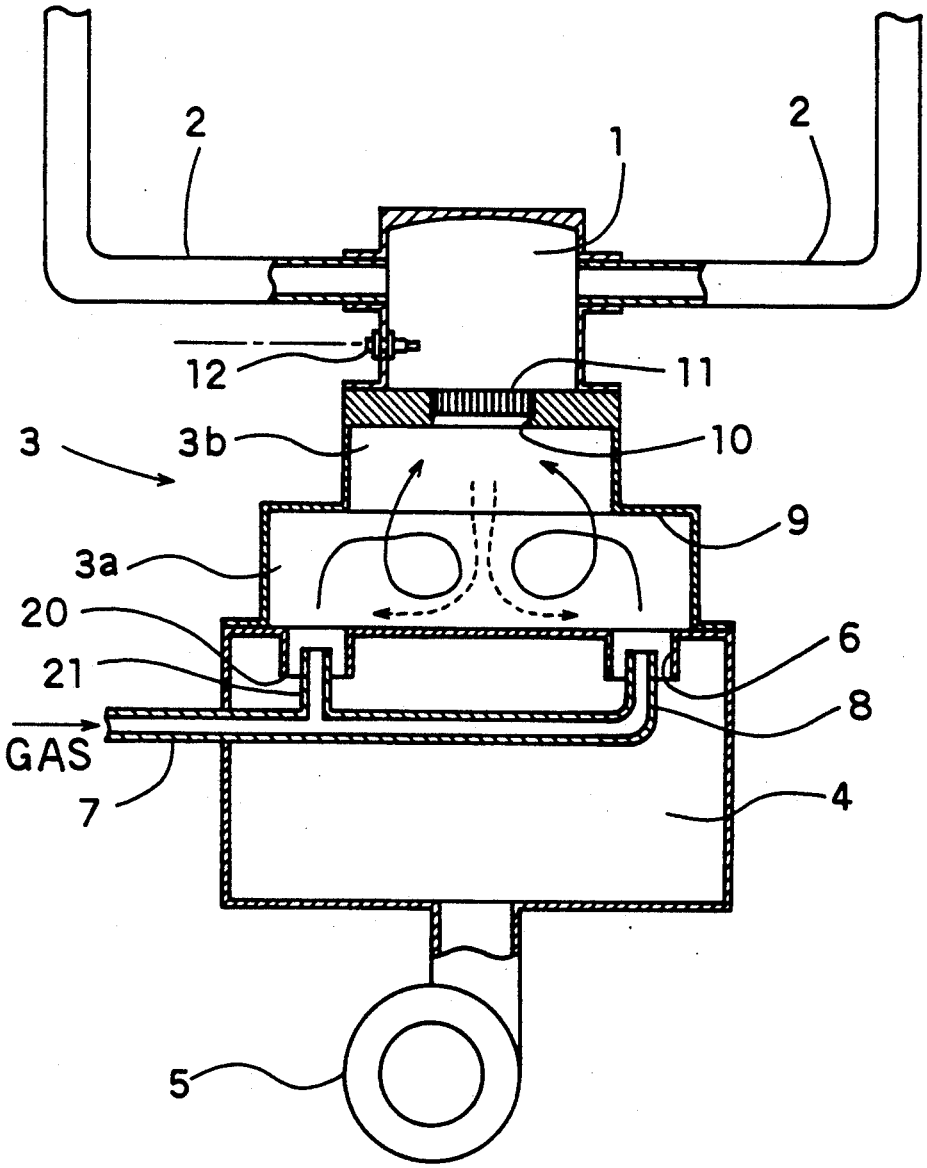
FIG. 2 is a cross sectional view schematically illustrating a pulse combustor as another embodiment of the invention.

The back-flown combustion byproducts are diluted with the air/fuel mixture spirally flowing in the mixing chamber 3 and fed to the combustion chamber 1. That is, the back flow of exhausted gas does not hinder the smooth combustion. The flame trap 11 between the combustion chamber 1 and the mixing chamber 3 rectifies the air/fuel mixture to control the ignition point in the combustion chamber 1, thus allowing stable pulse combustion. Although both the fuel gas and air are supplied through one opening, that is, the second opening 6, to the mixing chamber 3 in the pulse combustor of the embodiment, the air chamber 4 may include two openings so as to enhance the mixing process in the mixing chamber 3 as shown in FIG. 2. In the latter case, a second opening 6 and a third opening 20 of an identical shape are symmetrically formed in the air chamber 4, and a second end 21 diverged from the gas supply conduit 7 is disposed on the center axis of the third opening 20.

Figure 3:
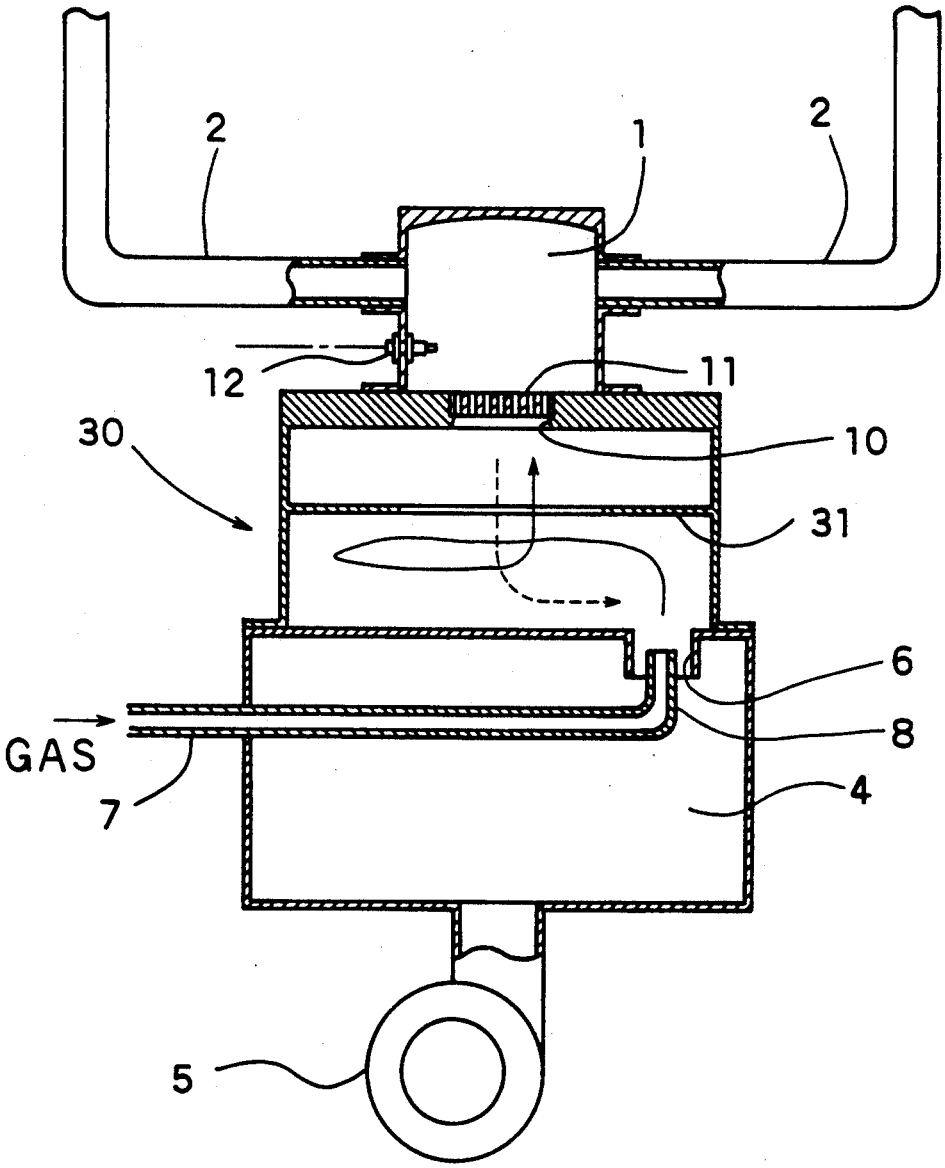
FIG. 3 is a cross sectional view schematically illustrating a pulse combustor as still another embodiment of the invention.

A cylindrical mixing chamber 30 with a ring collision plate 31 shown in FIG. 3 may be used in place of the mixing chamber 3 including the first chamber portion **3*a* and the second chamber portion 3*b* via the ring wall 9 shown in FIG. 1**.

Other possible structures of the conduit end 8 are given below.

Figure 4:
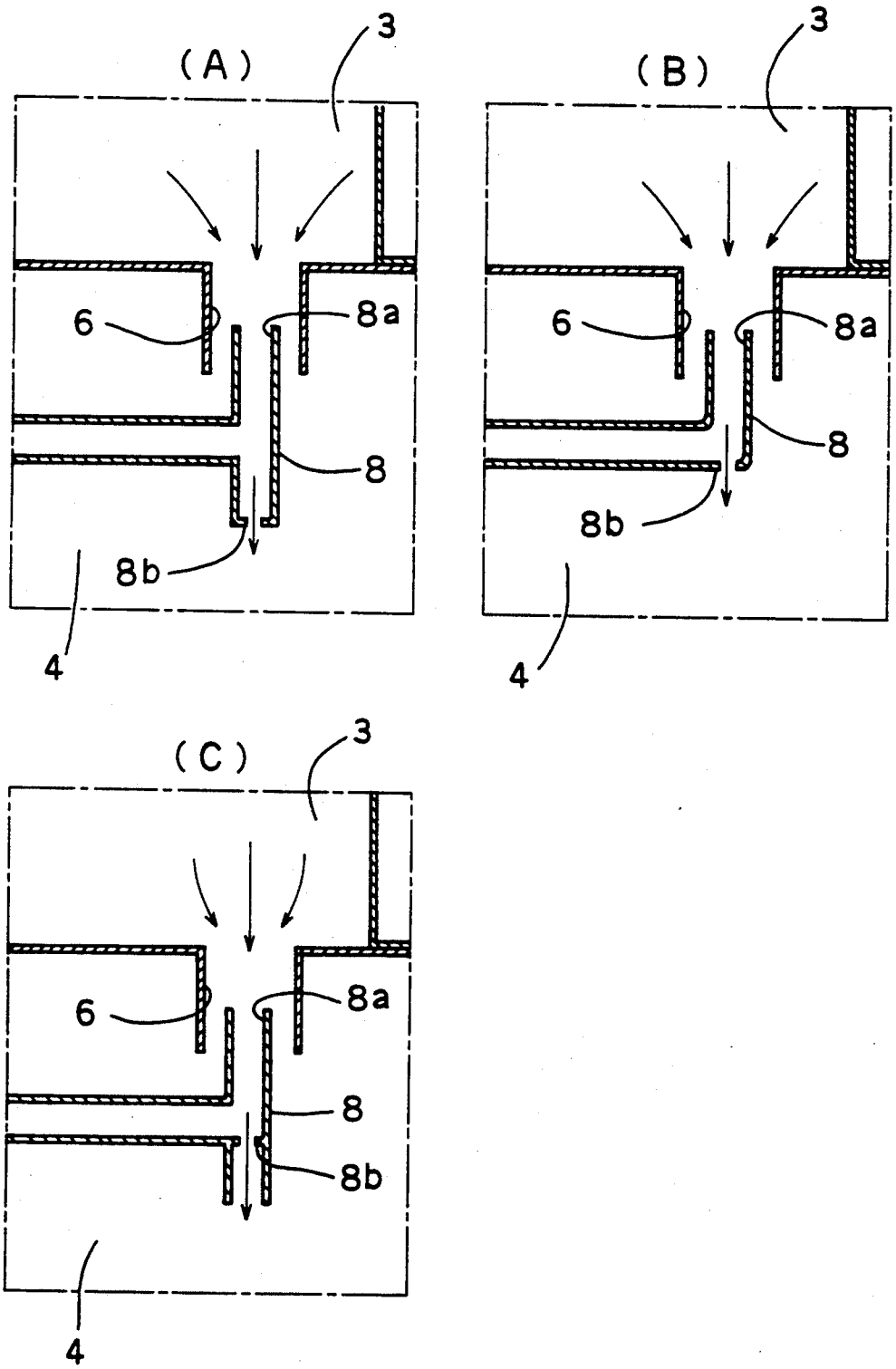
FIGS. 4(A) through 4(C) are cross sectional views showing structures of the conduit end.

FIGS. 4(A) through 4(C) are cross sectional views schematically illustrating structures of the conduit end 8; the conduit end 8 has T shape in FIGS. 4(A) and 4(C) and L shape in FIG. 4(B). In these examples, the conduit end 8 includes: an injection opening **8*a* for injecting the fuel gas; and an aperture 8*b* having a smaller diameter than the injection opening 8*a*. The aperture 8*b* formed opposite to the injection opening 8*a*** has the following effects.

The combustion byproducts flown back through the mixing chamber 3, the second opening 6 into the injection opening **8*a* can efficiently be discharged to the air chamber 4 via the aperture 8*b*. Since the aperture 8*b* has the smaller diameter than the injection opening 8*a*, the aperture 8*b* efficiently prevents the fuel gas from flowing through the aperture 8*b* into the air chamber 4. A small amount of the air in the air chamber 4 flows through the aperture 8*b* into the conduit end 8, but the ingested air does not prevent smooth supply of the fuel gas but has so-called venturi effect. Namely, the fuel gas is smoothly fed into the mixing chamber 3** by the supply pressure of the fuel gas and the venturi effect of the ingested air.

The pulse combustion is generally affected by the supply pressure of fuel gas under the reverse pressure conditions, and becomes unstable at the lower supply pressure. The aperture **8*b***, however, efficiently eliminates the adverse effects of the variation in supply pressure and realizes stable pulse combustion at any supply pressure.

Figure 5:
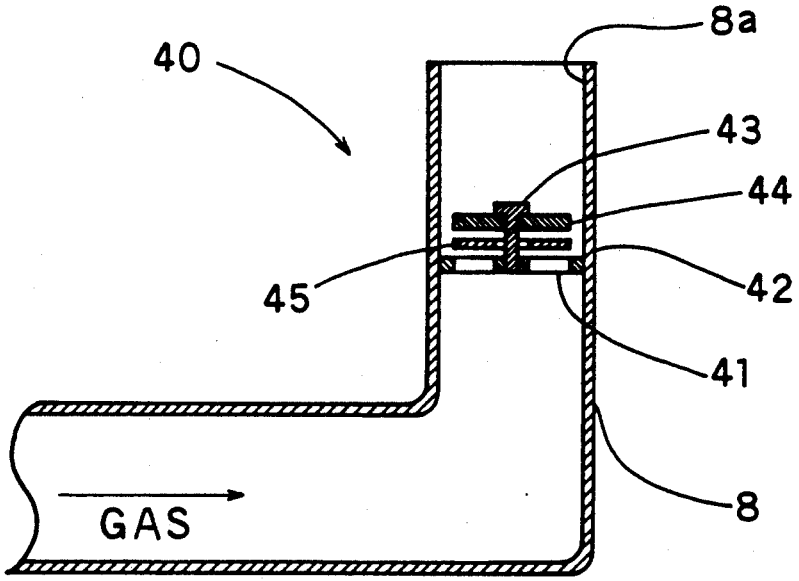
FIG. 5 is a cross sectional view schematically illustrating a check valve unit disposed in the conduit end.
Figure 6:
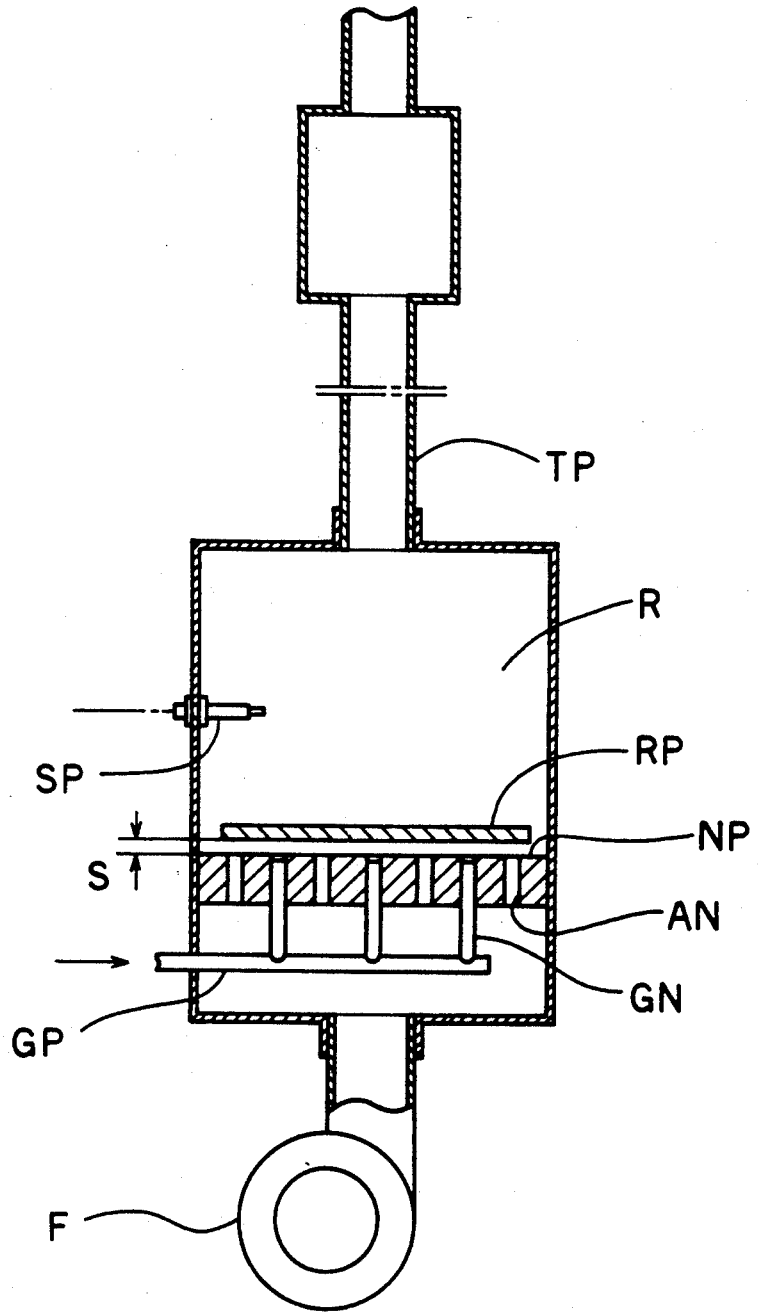
Fig.6 PRIOR ART
FIG. 6 is a cross sectional view schematically illustrating a conventional pulse combustor.

The conduit end 8 may also include a check valve unit 40 as shown in FIG. 5.

The check valve unit 40 includes: a base plate 42 attached to the inner wall of the conduit end 8; a number of radially extending slits 41 disposed on the base plate 42; a back-up ring plate 44 fixed to a support shaft 43 uprightly mounted on the center of the base plate 42; and a thin ring valve plate 45 movable along the axis between the base plate 42 and the back-up plate 44.

When the air/fuel mixture is ignited and combusted, the reverse pressure presses the valve plate 45 against the base plate 42 and closes the slits 41, thus preventing the exhausted gas from flowing back through the second opening 6 into the gas supply conduit 7. When the supply pressure of fuel gas becomes greater than the reverse pressure, the valve plate 45 moves towards the back-up plate 44 to open the slits 41, so that the fuel gas is fed through the injection opening **8*a*. Since the mixing chamber 3 is separated from the air chamber 4, the mixing chamber 3** can hold relatively large negative pressure. This structure realizes stable pulse combustion at any supply pressure.

As described above, the pulse combustor of the invention sufficiently mixes the fuel gas with the air and a small amount of back-flown combustion byproducts in the mixing chamber, thus allowing stable pulse combustion. The pressure of the back-flown exhausted gas (combustion byproducts) is lowered through the frame trap. The mixing chamber and the air chamber greatly reduce the reverse pressure so as to eliminate the adverse effects of the reverse pressure on gas and air supply sources. The structure of the invention does not require any high-pressure supply unit but efficiently reduces the undesirable noise and vibration.

The collision plate disposed in the mixing chamber further enhances the mixing process. The aperture or check valve unit in the gas supply conduit realizes stable pulse combustion at any supply pressure.

Since the invention may be embodied in other forms without departing from the scope or spirit of essential characteristics thereof, it is clearly understood that the above embodiment is only illustrative and not restrictive in any sense. The spirit and scope of the present invention is limited only by the terms of the appended claims.

What is claimed is:

1. A pulse combustor for continuous combustion of air/fuel mixture, comprising:

a combustion chamber receiving mixture of air and fuel gas for pulsative combustion;

one or plural tail pipes connecting to said combustion chamber for exhausting combustion byproducts from said combustion chamber;

a mixing chamber being coupled with and connected to said combustion chamber via a first opening provided with a flame trap, for mixing air and fuel gas and supplying the air/fuel mixture to said combustion chamber;

an air chamber being coupled with and connected to said mixing chamber via a second opening formed on a face opposite to said first opening, for supplying air to said mixing chamber;

a fan for feeding air into said air chamber; and a gas supply conduit for supplying fuel gas to said mixing chamber, said gas supply conduit going through said air chamber and having one end projecting to connect with said mixing chamber via said second opening;

wherein said second opening is formed eccentrically with respect to said first opening.

2. A pulse combustor in accordance with claim 1, wherein the one end of said gas supply conduit is formed in L shape or T shape.

3. A pulse combustor in accordance with claim 2 wherein the one end of said gas supply conduit comprises: an injection opening for injecting fuel gas to said mixing chamber; and an aperture having a smaller diameter than said injection opening, said aperture being formed opposite to said injection opening.

4. A pulse combustor in accordance with claim 1, wherein said mixing chamber further comprises a first chamber portion of a relatively large diameter and a second chamber portion of a relatively small diameter, which are concentrically disposed and connected to each other via a ring wall, air and fuel gas colliding against said ring wall to be spirally stirred and mixed.

5. A pulse combustor in accordance with claim 1, wherein said mixing chamber comprises a ring collision plate disposed between said first opening and said second opening, fuel gas and air colliding against said ring collision plate to be spirally stirred and mixed.

6. A pulse combustor in accordance with claim 1 wherein the one end of said gas supply conduit further comprises a check valve for preventing back flow of combustion byproducts into said gas supply conduit.

7. A pulse combustor for continuous combustion of air/fuel mixture, comprising:

a combustion chamber receiving mixture of air and fuel gas for pulsative combustion;

two tail pipes connecting to said combustion chamber for exhausting combustion byproducts from said combustion chamber;

a mixing chamber being coupled with and connected to said combustion chamber via a first opening provided with a flame trap, for mixing air and fuel gas and supplying the air/fuel mixture to said combustion chamber.

an air chamber being coupled with and connected to said mixing chamber via a second opening and a third opening for supplying air to said mixing chamber, said second opening and said third opening being formed opposite to said first opening;

a fan for feeding air into said air chamber; and a gas supply conduit for supplying fuel gas to said mixing chamber, said gas supply conduit going through said air chamber and having a first end connecting with said mixing chamber via said second opening, and a second end connecting with said mixing chamber via said third opening.

8. A pulse combustor in accordance with claim 7 wherein said second opening and said third opening are formed eccentrically with respect to said first opening.

9. A pulse combustor in accordance with claim 8 wherein at least either the first end or the second end of said gas supply conduit comprises: an injection opening for injecting fuel gas to said mixing chamber; and an aperture having a smaller diameter than said injection opening, said aperture being formed opposite to said injection opening.

10. A pulse combustor in accordance with claim 8 wherein at least either the first end or the second end of said gas supply conduit further comprises a check valve for preventing back flow of combustion byproducts into said gas supply conduit.

* * * * *